United States Patent [19]

Bell

[11] Patent Number: 4,495,870

[45] Date of Patent: Jan. 29, 1985

[54] EXTERNAL TRACER FOR GUN LAUNCHED PROJECTILES

[75] Inventor: Frank H. Bell, Logan, Utah

[73] Assignee: Thiokol Corporation, Chicago, Ill.

[21] Appl. No.: 403,980

[22] Filed: Aug. 2, 1982

[51] Int. Cl.[3] ..... F42B 11/20; F42B 11/16

[52] U.S. Cl. ..... 102/511; 102/513

[58] Field of Search ..... 102/431, 458, 501, 513, 102/514–516, 290; 149/37, 40, 44, 15

[56] References Cited

U.S. PATENT DOCUMENTS

| | | | |
|---|---|---|---|
| 1,126,415 | 1/1915 | Dickinson et al. | 102/513 |
| 3,875,864 | 4/1975 | Ambrosini et al. | 102/703 X |
| 3,945,202 | 3/1976 | Marion et al. | 149/19.3 X |
| 3,981,756 | 9/1976 | Gotzmer, Jr. | 149/19.3 |
| 4,019,932 | 4/1977 | Schroeder | 149/37 X |
| 4,062,709 | 12/1977 | Castaneda et al. | 102/290 X |
| 4,094,711 | 6/1978 | Ramnarace | 102/513 X |
| 4,131,498 | 12/1978 | Lucy | 149/114 X |
| 4,328,750 | 5/1982 | Oberg et al. | 102/514 |

*Primary Examiner*—Harold J. Tudor

*Attorney, Agent, or Firm*—Gerald K. White

[57] ABSTRACT

An external burning tracer-type projectile which is visible from many angular positions and not just the base includes a hardened metallic core that is completely encased in a combustible, self-oxidizing polymer jacket that is loaded with powdered fuels and oxidizers and which is ignited by the heat of the propelling charge of gun powder.

5 Claims, 2 Drawing Figures

EXTERNAL TRACER FOR GUN LAUNCHED PROJECTILES

BACKGROUND OF THE INVENTION

1. Field of the Invention

The present invention relates to improvements in tracer cartridges or projectiles for visually aiding the aiming and firing of guns.

2. Description of the Prior Art

The terms"projectile" or "bullet" are used herein to designate the complete round, including cartridge case, propellant and primer. Armor piercing projectiles usually consist of a hardened steel core, gilding metal jacket and lead filler to fill the space between the point of the core and the point of the jacket.

Tracer-type projectiles have long been known in the prior art. Such projectiles facilitate the accurate aiming and firing of guns. This is because the flight path of the projectile can be followed with the eye and correction made as required to hit the target. Tracing is particularly useful as a visual aid in combat and military training, especially at night.

Projectiles with the tracing feature, in the prior art, have been of the base burning or base fuming type, similar to a nozzleless and throatless end burning solid propellant rocket motor. Tracer compositions, a chemical agent that emits light, that is, visible radiation, or smoke, are usually arranged to be ignited by hot propellant gases and do not utilize an igniter of any kind.

Base-burning tracer-type projectiles have a number of disadvantages, one of which is their visibility from the base only. Others include limitations on (a) their velocity for a given bullet mass and form coefficient, and (b) permissible bullet core hardness, because of bore friction. There thus exists a need and a demand in the art for an improvement in tracer-type projectiles.

SUMMARY OF THE INVENTION

An object of the invention is to provide an improved tracer-type projectile which may be seen from many angular positions and not just from the base.

Another object of the invention is to provide a tracer projectile or bullet having a higher velocity for a given bullet mass and form coefficient than conventional bullets employing conventional gilding metal jacket materials.

A further object of the invention is to provide such an improved tracer-type projectile or bullet wherein the metallic bullet core can be harder than hardness levels considered to be standard practice in the prior art without undue increase in the maximum bore pressure, whereby a standard propelling charge may be used.

In accomplishing these and other objectives of the invention, there is provided an external burning tracer comprising a combustible, self-oxidizing magnesium-polytetrafluoroethylene jacket which encloses a metallic projectile or bullet. The tracer composition jacket is ignited by the heat of the propelling charge of the gun powder. Burning may be ring-like from base to nose or all over, almost simultaneously.

In order to prevent all over burning, a thin coat of pure tetrafluoroethylene or other plastic polymer is required over the tracer composition jacket at areas thereof at which it is desired to inhibit burning.

BRIEF DESCRIPTION OF THE DRAWING

Having summarized the invention, a detailed description follows with reference being had to the accompanying drawings of which FIG. 1 comprises a cross section of a projectile or bullet that is completely encased in a tracer composition jacket in accordance with the invention.

DESCRIPTION OF THE PREFERRED EMBODIMENT

Figure 1:
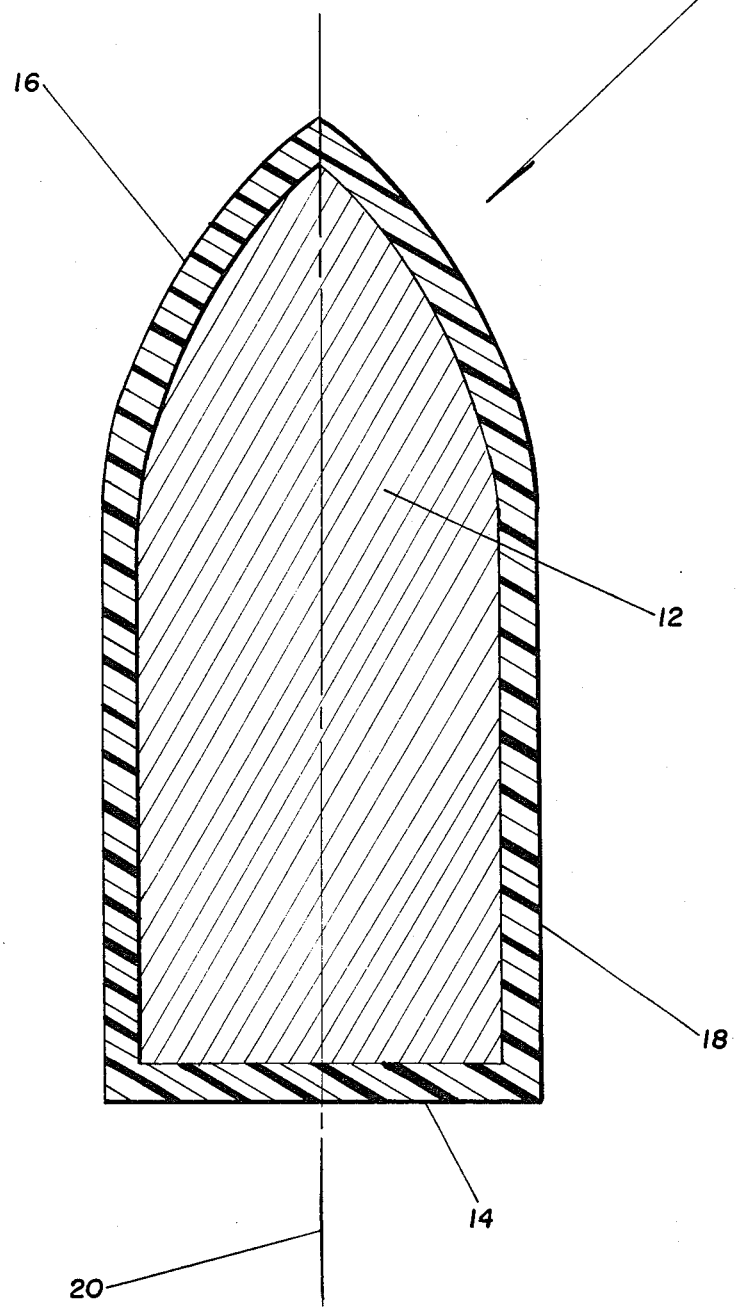

The projectile or bullet, indicated at 10 in the drawing, is cylindrical in shape and includes a metallic cartridge or core 12 which may be hardened. Projectile 10 includes a flat base 14 and a pointed nose 16, and is completely encased in a tracer composition jacket 18. The longitudinal center line of the projectile 10 is indicated by a dot and dash line to which reference numeral 20 has been applied.

Jacket 18 is composed of a polymer in which powdered fuels and oxidizers are integrated. Typically, the composition of the tracer composition jacket 18 may contain the following constituents, in the amounts indicated:

| Constituent | Weight Percent |
|---|---|
| Iron Oxide ($Fe_2O_3$) | 24.0 |
| Lead Dioxide ($PbO_2$) | 20.0 |
| Aluminum Powder | 0.0 to 6.0 |
| Magnesium Powder (Granulation range No. 10 to No. 16) | 25.0 ± 10.0 |
| PTFE (TL-115)* | 14.9 ± 5.0 |
| Viton-A** | 10.1 ± 5.0 |

*PTFE (TL-115) is a generic designation for polytetrafluoroethylene.
**Viton-A is the trademark of E. I. DuPont de Nemours & Co., Wilmington, Delaware, for a copolymer of vinylidenefluoride and perfluoropropylene.

The burning rate and light output may be adjusted by varying the particle size of the Magnesium powder, Aluminum Powder, Iron Oxide and the relative amount of fuels to oxidizers. The oxidizing and fuel constituents are, as follows:

| Oxidizers | Fuels |
|---|---|
| Iron Oxide | Aluminum Powder |
| PTFE (TL-115) | Magnesium Powder |
| Viton-A | Carbon (from PTFE (TL-115), Viton-A) |
| Lead Dioxide | Hydrogen (from Viton-A) |

The strength of the polymer jacket 18 is largely controlled by the amount of PTFE and Viton-A and the ratio of PTFE and Viton-A.

Figure 2:
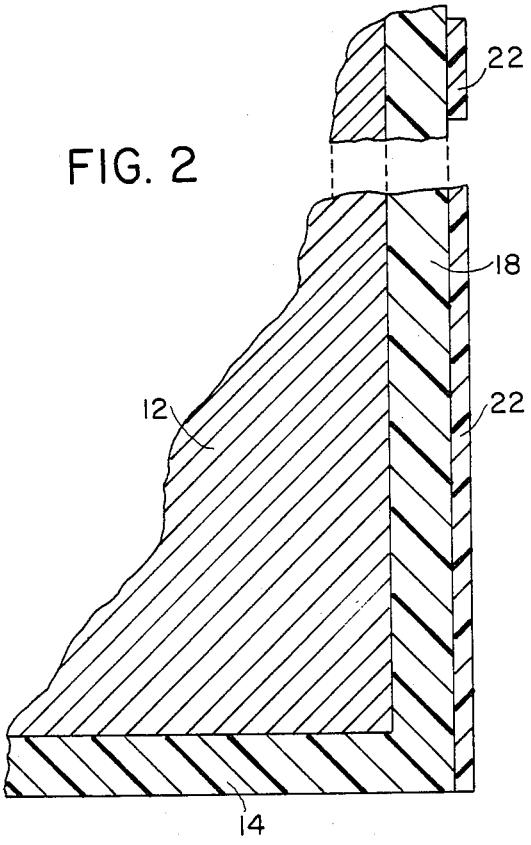
FIG. 2 shows a fragmented section on an enlarged scale of a modified form of the projectile of FIG. 1 incorporating a thin external coating of polymer for inhibiting burning on selected areas of the projectile.

In order to preclude all over burning, a coating 22 of pure tetrafluoroethylene or other polymer without any fuel may be applied to the jacket 18 everywhere except where burning is desired, such for example, only at the base, as shown in FIG. 2.

There has thus been provided, in accordance with the invention, an improved tracer-type projectile which may be seen from many angles and not just from the base. The improved tracer-type projectile permits a higher velocity for a given projectile or bullet mass and form coefficient since a polytetrafluoroethylene jacket exhibits markedly less bore friction than conventional gilding metal jacket materials. Also, due to reduced jacket friction, polytetrafluoroethylene jacketed projectiles or bullets exhibits superior penetration. Additionally, since the jacket is a relatively soft polymer, the metallic bullet core can be harder than has been permissible with prior art projectiles and bullets without undue increase in the maximum bore pressure. As a result, a standard propelling charge may be used.

What is claimed is:

1. An external burning tracer-type projectile comprising:

a metallic core, and a tracer composition jacket completely encasing said core, said jacket being composed of a combustible mixture of fuel and oxidizer, said oxidizer serving also as a lubricant upon firing of the projectile from the rifle barrel of a gun for reducing the bore friction.

2. A projectile as specified in claim 1 wherein said tracer composition jacket is composed of a polymer in which powdered fuels and oxidizers are integrated.

3. A projectile as specified in claim 2 wherein said oxidizer includes polytetrafluoroethylene and said fuel includes magnesium.

4. A projectile as specified in claim 2 in which said tracer composition jacket consists essentially of the following constituents in the amount specified:

| | Weight Percent |
|---|---|
| Iron Oxide ($Fe_2O_3$) | 24.0 |
| Lead Dioxide ($PbO_2$) | 20.0 |
| Aluminum Powder | 0.0 to 6.0 |
| Magnesium Powder (Granulation range No. 10 to No. 16) | 25.0 ± 10.0 |
| PTFE (TL-115) | 14.9 ± 5.0 |
| Copolymer of vinylidenefluoride and perfluoropropylene | 10.1 ± 5.0 |

5. A projectile as specified in claim 1 wherein said tracer composition jacket includes an external coating of pure plastic polymer at areas thereof at which it is desired to inhibit burning.

* * * * *